US009920988B2

(12) United States Patent
Chakravarthy et al.

(10) Patent No.: US 9,920,988 B2
(45) Date of Patent: Mar. 20, 2018

(54) MAIN HEAT EXCHANGE SYSTEM AND METHOD FOR REBOILING

(71) Applicants: Vijayaraghavan S. Chakravarthy, Williamsville, NY (US); Michael J. Lockett, Grand Island, NY (US); Dante P. Bonaquist, Boalsburg, PA (US); Maulik R. Shelat, Williamsville, NY (US); Karl K. Kibler, Amherst, NY (US)

(72) Inventors: Vijayaraghavan S. Chakravarthy, Williamsville, NY (US); Michael J. Lockett, Grand Island, NY (US); Dante P. Bonaquist, Boalsburg, PA (US); Maulik R. Shelat, Williamsville, NY (US); Karl K. Kibler, Amherst, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 96 days.

(21) Appl. No.: 15/242,961

(22) Filed: Aug. 22, 2016

(65) Prior Publication Data

US 2016/0356546 A1 Dec. 8, 2016

Related U.S. Application Data

(62) Division of application No. 14/296,588, filed on Jun. 5, 2014, now Pat. No. 9,453,674.

(Continued)

(51) Int. Cl.
*F25J 3/04* (2006.01)
*F25J 5/00* (2006.01)

(52) U.S. Cl.
CPC ..... *F25J 3/0486* (2013.01); *F25J 3/04412* (2013.01); *F25J 3/04769* (2013.01);

(Continued)

(58) Field of Classification Search
CPC .. F25J 3/04412; F25J 2200/54; F25J 2250/02; F25J 2250/04; F25J 2250/10; F25J 2250/20
See application file for complete search history.

(56) References Cited

U.S. PATENT DOCUMENTS 4,372,765 A 2/1983 Tamura et al.
4,436,146 A 3/1984 Smolarek (Continued)

FOREIGN PATENT DOCUMENTS

CA 2 329 490 A1 6/2001
DE 1152432 B 8/1963

(Continued)

OTHER PUBLICATIONS

B. Tammami; How to Select the Best Reboiler for Your Processing Operation; Hydrocarbn Processing, Gulf Publishing Co. Houston, US; No. 3; Jan. 1, 2008; pp. 91-94; XP001538370.

*Primary Examiner* — Tareq Alosh
(74) *Attorney, Agent, or Firm* — Robert J. Hampsch; David M. Rosenblum

(57) ABSTRACT

A method and main heat exchange system for use in a cryogenic air separation plant in which down-flow and thermosiphon heat exchangers are employed to partially vaporize an oxygen-rich liquid produced in a lower pressure column and to condense the nitrogen-rich vapor in a higher pressure column. A greater proportion of the oxygen-rich liquid can be partially vaporized in the down-flow heat exchangers than in the thermosiphon heat exchangers and the nitrogen-rich vapor condensed in the thermosiphon heat exchangers can have a higher oxygen content than the nitrogen-rich vapor condensed in the down-flow heat exchangers. This allows the higher pressure column to operate at a lower pressure than would otherwise be possible. A central conduit can extend from the higher pressure (Continued)

column into the lower pressure column to introduce the nitrogen-rich vapor into at least the down-flow heat exchangers for purposes of reducing pressure drop and column height.

3 Claims, 4 Drawing Sheets

Related U.S. Application Data

(60) Provisional application No. 61/916,414, filed on Dec. 16, 2013.

(52) U.S. Cl.
CPC ..... *F25J 3/04787* (2013.01); *F25J 3/04824* (2013.01); *F25J 3/04884* (2013.01); *F25J 5/005* (2013.01); *F25J 2200/52* (2013.01); *F25J 2200/54* (2013.01); *F25J 2250/02* (2013.01); *F25J 2250/04* (2013.01); *F25J 2250/10* (2013.01); *F25J 2250/20* (2013.01)

(56) References Cited

U.S. PATENT DOCUMENTS

| | | | |
|---|---|---|---|
| 4,606,745 | A | 8/1986 | Fujita |
| 5,071,458 | A | 12/1991 | Grenier et al. |
| 5,392,609 | A | 2/1995 | Girault et al. |
| 5,699,671 | A | 12/1997 | Lockett et al. |
| 5,956,972 | A | 9/1999 | Naumovitz |
| 6,393,866 | B1 | 5/2002 | Srinivasan et al. |
| 2007/0028649 | A1 | 2/2007 | Chakravarthy et al. |
| 2009/0084133 | A1 | 4/2009 | Chakravarthy et al. |

FOREIGN PATENT DOCUMENTS

| | | | |
|---|---|---|---|
| DE | 1 949 609 | | 4/1971 |
| DE | 19605500 | C1 | 4/1997 |
| EP | 1067344 | A1 | 1/2001 |
| FR | 1 212 896 | | 3/1960 |
| FR | 2 853 723 | A1 | 10/2015 |
| JP | 2006-266532 | | 10/2006 |
| WO | WO 99/39143 | | 8/1999 |

MAIN HEAT EXCHANGE SYSTEM AND METHOD FOR REBOILING

RELATED APPLICATIONS

This divisional application claims the benefit of U.S. Provisional Application Ser. No. 61/916,414, filed on Dec. 16, 2013, and U.S. patent application Ser. No. 14/296,588, filed on Jun. 5, 2014, which are incorporated herein by reference.

FIELD OF THE INVENTION

The present invention relates to a main heat exchange system for use in connection with a double column arrangement of a cryogenic air separation plant in which the heat exchange system partially vaporizes an oxygen-rich liquid produced in a lower pressure column through indirect heat exchange with nitrogen-rich vapor produced in a higher pressure column. More particularly, the present invention relates to such a method and main heat exchange system in which a hybrid arrangement of down-flow heat exchangers and thermosiphon heat exchangers are employed to partially vaporize the oxygen-rich liquid and to condense the nitrogen-rich vapor and a central conduit extending from the higher pressure column into the lower pressure column is used to introduce nitrogen-rich vapor into the down-flow heat exchangers.

BACKGROUND

Air is separated by cryogenic rectification conducted in air separation plants through the distillation of the air within distillation column systems that include higher and lower pressure columns. In such air separation plants, compressed and purified air is distilled in the higher pressure column to produce a nitrogen-rich vapor column overhead and a crude oxygen column bottoms also known as kettle liquid. A stream of the crude oxygen is further refined in the lower pressure column that operates at a lower pressure than the higher pressure column. This further refinement of the crude liquid oxygen within the lower pressure column produces an oxygen-rich liquid and a nitrogen-rich vapor column overhead. Oxygen-rich and nitrogen-rich liquid and vapor products can be produced in such air separation plants.

The higher and lower pressure columns are operatively associated with one another in a heat transfer relationship in which the oxygen-rich liquid produced in the lower pressure column is passed in indirect heat exchange with a stream of the nitrogen-rich vapor column overhead removed from the higher pressure column. This results in condensation of the nitrogen-rich vapor and partial vaporization of the oxygen-rich liquid to produce boilup and thus, initiation of the formation of an ascending vapor phase of the mixture to be distilled in the lower pressure column. The condensed nitrogen-rich vapor can be used in generating reflux for the distillation conducted in both the higher and lower pressure columns. In this regard, the reflux so generated can be fed exclusively to the higher pressure column. In such case, the lower pressure column can be refluxed with a nitrogen containing liquid stream withdrawn from the higher pressure column at a location thereof where such liquid stream has a higher concentration of oxygen than the column overhead of the higher pressure column that is condensed in the lower pressure column.

It is to be noted that the heat transfer relationship between the columns is made possible by the fact that the nitrogen-rich vapor is at a higher pressure within the higher pressure column than the oxygen-rich liquid within the lower pressure column. Since the nitrogen-rich vapor is at the higher pressure, it will be warmer than the oxygen-rich liquid and thereby will be able to be condensed by the oxygen-rich liquid. It is to be noted that since the lower pressure column operates at a lower pressure than the higher pressure column, the volatility spread between the oxygen and nitrogen will be greater than in the higher pressure column to also enable the further refinement of the crude liquid oxygen produced in the higher pressure column.

The indirect heat exchange between the oxygen-rich liquid and the nitrogen-rich vapor occurs in a heat exchanger known as a main heat exchanger or alternatively, as a condenser-reboiler. The heat exchanger can be of the down-flow type in which the oxygen-rich liquid flows in a downward direction to be partially vaporized. Such a down-flow heat exchanger can be of plate-fin, brazed aluminum design in which the passages containing fins are formed between parting sheets for the flow of the oxygen-rich liquid and the nitrogen-rich vapor. In another type of heat exchanger a set of tubes are provided that are enclosed by a shell. The oxygen-rich liquid is fed into the tubes and partially vaporizes to escape from the bottom of the tubes into the lower pressure column. The nitrogen-rich vapor is fed to the shell for contact with the tubes and thus, condensation through indirect heat exchange with the oxygen-rich liquid. As shown in U.S. Patent Appln. Ser. No. 2007/0028649, heat transfer can be enhanced by providing the inside of the tubes with an enhanced boiling surface and the outside of the tubes with fins. In U.S. Pat. No. 6,393,866 the placement of fins and enhanced boiling surfaces is reversed and the heat exchanger shown in this patent is operated by feeding the nitrogen-rich vapor into the tubes and the oxygen-rich liquid onto the outer surfaces of the tubes. In both plate-fin and shell and tube heat exchangers, the oxygen-rich liquid is collected in the lower pressure column with a liquid collector and then fed to the down-flow heat exchanger by means of a liquid distributor.

In another type of heat exchanger, known as a thermosiphon heat exchanger, the oxygen-rich liquid collects within a sump of the lower pressure column or a shell located outside of a bottom region of such column. The nitrogen-rich vapor is then fed to the heat exchanger which sits in liquid located in the sump. The liquid vaporizes within passages of such a heat exchanger and as the liquid vaporizes; its density decreases so that the liquid flows up the passages and is discharged with the vapor from the top of such a heat exchanger. Thermosiphon heat exchangers have similarly been based on both plate-fin and shell and tube designs.

With reference to U.S. Pat. No. 5,071,458, a hybrid arrangement of a down-flow heat exchanger and a thermosiphon type of heat exchanger is situated in the sump of a lower pressure column of an air separation plant. The thermosiphon heat exchangers are situated below the down-flow heat exchangers. Oxygen-rich liquid is collected in a distributor that is fed to the down-flow heat exchangers. Partial vaporization of the oxygen-rich liquid results in residual liquid being collected in the sump for partial vaporization of such sump liquid within the thermosiphon heat exchangers. Upon a cold shutdown of the air separation plant, liquid will tend to fall through mass transfer contacting elements overlying the bottom region of the lower pressure column to collect in the sump. Since the down-flow heat exchanger will not function when submerged, while thermosiphon heat exchangers will continue to function under such circumstances, the thermosiphon heat exchangers take over during a restart of the plant and the resulting heat exchange will cause the liquid level in the sump to drop to a lower level at which the down-flow heat exchangers will again be able to function.

As mentioned above, the ability of the nitrogen-rich vapor, produced in the higher pressure column, to be condensed by the oxygen-rich liquid, produced in the lower pressure column, is dependent upon the higher pressure in the higher pressure column over that obtained in the lower pressure column. An advantage of down-flow heat exchangers is that they can operate at a lower temperature difference between condensing and boiling streams than thermosiphon heat exchangers. Therefore, when the condensing reboiling function is taken advantage of solely through the use of down-flow heat exchangers associated with the lower pressure column, the higher pressure column can operate at a lower pressure than would otherwise be required with the use of thermosiphon heat exchangers. Since the pressure of the higher pressure column is a function of the degree to which air is compressed in the air separation plant, a reduction in the required pressure will lower electrical power costs incurred in compressing the air. However, in the hybrid arrangement discussed above, the thermosiphon heat exchanger will require warmer nitrogen than the down-flow heat exchanger in order to indirectly exchange heat with the oxygen-rich liquid. Therefore, the thermosiphon heat exchanger will act as a limit upon the degree to which operational pressure is able to be lowered in the higher pressure column.

As will be discussed, among other advantages of the invention that will be discussed in detail hereinafter, the present invention provides a hybrid main heat exchange system in which lower temperature differences are able to be obtained in the down-flow heat exchanger to in turn lower required pressures and operating costs of the air separation plant.

SUMMARY OF THE INVENTION

The present invention relates to a method of reboiling a lower pressure column of a double column arrangement. In accordance with such method, an oxygen-rich liquid is partially vaporized within a down-flow heat exchange zone and a thermosiphon heat exchange zone that is situated below the down-flow heat exchange zone. In this regard, the term, "down-flow heat exchange zone" means a heat transfer zone in which indirect heat exchange is accomplished with the use of one or more down-flow heat exchangers. Similarly, the term, "thermosiphon heat exchange zone" means a heat transfer zone in which indirect heat exchange is carried out with the use of one or more thermosiphon heat exchangers. The oxygen-rich liquid is produced as a result of a distillation of an oxygen and nitrogen containing mixture within the lower pressure column and the partial vaporization of the oxygen-rich liquid initiates the formation of an ascending vapor phase of the oxygen and nitrogen containing mixture to be distilled within the lower pressure column. A greater proportion of the oxygen-rich liquid is partially vaporized within the down-flow heat exchange zone than within the thermosiphon heat exchange zone and at a lower temperature difference than that of the thermosiphon heat exchange zone. The partial vaporization of the oxygen-rich liquid within the down-flow heat exchange zone occurs through indirect heat exchange between the oxygen-rich liquid, as the oxygen-rich liquid moves in a downward direction, with a first nitrogen-rich vapor stream, composed of nitrogen-rich vapor column overhead produced in a higher pressure column of the double column arrangement, thereby condensing the first nitrogen-rich vapor stream. The partial vaporization of the oxygen-rich liquid within the thermosiphon heat exchange zone occurs through indirect heat exchange between residual liquid, produced as a result of the partial vaporization of the oxygen-rich liquid within the down-flow heat exchange zone and drawn in an upward direction through thermosiphon effect, with a second nitrogen-rich vapor stream, thereby condensing the second nitrogen-rich vapor stream. The second nitrogen-rich vapor stream is withdrawn from the higher pressure column at a location thereof below the first nitrogen-rich vapor stream and with a greater oxygen concentration than the first nitrogen-rich vapor stream such that a sufficient temperature difference is able to be maintained within the thermosiphon heat exchange zone at an operational pressure of the lower pressure column at which the partial vaporization of the oxygen-rich liquid is conducted. The first nitrogen-rich vapor stream, after having been condensed, at least in part, is returned to the higher pressure column as reflux and the second nitrogen-rich vapor stream, after having been condensed, at least in part, introduced into at least one of the higher pressure column and the lower pressure column.

Since most of the partial vaporization occurs within the down-flow heat exchange zone and with a closer temperature approach than in the thermosiphon zone, the higher pressure column can be operated at a lower pressure than would otherwise be possible with the use of thermosiphon heat exchangers alone. In the present invention, however, the thermosiphon heat exchangers do not limit the temperature approach within the down-flow heat exchange zone because a higher temperature difference is able to be obtained in the thermosiphon heat exchangers thereof with the use of the second nitrogen-rich vapor stream that has a higher oxygen content than the first nitrogen-rich vapor stream and is therefore, warmer than the first nitrogen-rich vapor stream at the same higher column pressure. Consequently, energy savings are able to be realized in the present invention that would not be possible in prior art hybrid arrangements.

Preferably, during normal operation of the lower pressure column and the higher pressure column, a flow ratio between the first nitrogen-rich vapor stream and total flow of the first nitrogen-rich vapor stream and the second nitrogen-rich vapor stream is maintained at a level of between 50.0 percent and 90.0 percent so that the greater heat exchange duty in the down-flow heat exchange zone can be maintained. Preferably, this flow ratio is 70.0 percent. During turn-down or restart operations, flow of the first nitrogen-rich vapor stream after having been condensed is restricted to partially flood the first condensing side of down-flow heat exchangers forming the down-flow heat exchange zone and thereby prevent partial dry-out on a vaporization side thereof located opposite to the condensing side. Also preferably, the down-flow heat exchange zone can be formed by a plurality of down flow heat exchangers, each having heat exchange tubes, within which the oxygen-rich liquid partially vaporizes and a shell enclosing the heat exchange tubes and into which the first nitrogen-rich vapor stream is introduced to perform the indirect heat exchange with the oxygen-rich liquid.

The present invention also provides a main heat exchange system for reboiling a lower pressure column of a double column arrangement. Said system comprises a down-flow heat exchange zone and a thermosiphon heat exchange zone, situated below the down-flow heat exchange zone, for partially vaporizing an oxygen-rich liquid produced as a result of a distillation of an oxygen and nitrogen containing mixture within the lower pressure column and initiating the formation of an ascending vapor phase of the oxygen and nitrogen containing mixture to be distilled within the lower pressure column. The down-flow heat exchange zone is configured to partially vaporize a greater proportion of the oxygen-rich liquid within the down-flow heat exchange zone than within the thermosiphon heat exchange zone and at a lower temperature difference than that of the thermosiphon heat exchange zone. The down-flow heat exchange zone has a first condensing side connected to the higher pressure column of the double column arrangement so that a first nitrogen-rich vapor stream, composed of nitrogen-rich vapor column overhead produced in the higher pressure column of the double column arrangement condenses through indirect heat exchange between the oxygen-rich liquid, as the oxygen-rich liquid moves in a downward direction. The thermosiphon heat exchange zone has a second condensing side to condense a second nitrogen-rich vapor stream through indirect heat exchange with a residual liquid, produced as a result of the partial vaporization of the oxygen-rich liquid within the down-flow heat exchange zone and drawn in an upward direction through thermosiphon effect. The second condensing side is connected to the higher pressure column at a location thereof below the first nitrogen-rich stream so that the second nitrogen-rich vapor stream has a greater oxygen concentration than the first nitrogen-rich stream and a sufficient temperature difference is able to be maintained within the thermosiphon heat exchange zone at an operational pressure of the lower pressure column at which the partial vaporization of the oxygen-rich liquid is conducted. The first and second condensing sides are connected to the higher pressure column and the lower pressure column so that the first nitrogen-rich vapor stream, after having been condensed, at least in part, returns to the higher pressure column as reflux.

Preferably, the down flow heat exchange zone and the thermosiphon heat exchange zone and conduits extending between the higher pressure column and the first condensing side and the second condensing side are configured such that during normal operation of the lower pressure column and the higher pressure column, a flow ratio between the first nitrogen-rich vapor stream and total flow of the first nitrogen-rich vapor stream and the second nitrogen-rich vapor stream is maintained at a level of between 50.0 percent and 90.0 percent. Preferably, the flow ratio is 70.0 percent. Additionally, a return conduit is in flow communication with the first condensing side of the down-flow heat exchange zone and the higher pressure column to return the reflux to the higher pressure column and, preferably, a flow control valve can be positioned within the return conduit. This flow control valve allows flow of the first nitrogen-rich vapor stream after having been condensed to be restricted during turn-down or restart operations, to partially flood the condensing side of down-flow heat exchangers forming the down-flow heat exchange zone and thereby prevent partial dry-out thereof on a vaporization side thereof located opposite to the condensing side. Preferably, the down-flow heat exchange zone is formed by a plurality of down flow heat exchangers, each having heat exchange tubes, within which the oxygen-rich liquid partially vaporizes and a shell enclosing the heat exchange tubes and into which the first nitrogen-rich vapor stream is introduced to perform the indirect heat exchange with the oxygen-rich liquid and thereby forming the first condensing side thereof.

A central conduit can extend from a dome forming a top end of the higher pressure column into the lower pressure column. The down-flow heat exchange zone can be formed by a plurality of down-flow heat exchangers radially situated in radial locations with respect to the central conduit. The first condensing sides of the down-flow heat exchangers are connected to the central conduit to receive the first nitrogen-rich vapor stream from the higher pressure column. The plurality of down-flow heat exchangers are connected to a shell of the lower pressure column and the thermosiphon heat exchange zone is a plurality of thermosiphon heat exchangers radially situated in radial locations with respect to the central conduit and between the down-flow heat exchangers and the dome such that the residual liquid collects within a region of the lower pressure column defined by the shell of the lower pressure column and the dome of the higher pressure column. This arrangement is particularly preferred in that it allows the lower pressure column to be constructed at a lower height than would otherwise be required without the use of the central conduit.

Whether or not the second stream of the nitrogen-rich vapor is used, the present invention also contemplates a main heat exchange system for reboiling a lower pressure column of a double column arrangement in which a plurality of down-flow heat exchangers and a plurality of thermosiphon heat exchangers, situated below the plurality of down-flow heat exchangers are provided for partially vaporizing an oxygen-rich liquid produced as a result of a distillation of an oxygen and nitrogen containing mixture within the lower pressure column and initiating the formation of an ascending vapor phase of the oxygen and nitrogen containing mixture to be distilled within the lower pressure column. The plurality of the down-flow heat exchangers are configured to partially vaporize a greater proportion of the oxygen-rich liquid than the plurality of the thermosiphon heat exchangers and the plurality of the down-flow heat exchangers and the plurality of thermosiphon heat exchangers have condensing sides connected to the higher pressure column of the double column arrangement so that at least one nitrogen-rich vapor stream condenses through indirect heat exchange with the oxygen-rich liquid occurring within the down flow heat exchangers and through indirect heat exchange with residual liquid occurring within the thermosiphon heat exchangers, the residual liquid formed from partial vaporization of the oxygen-rich liquid within the down-flow heat exchangers. The condensing sides of the down-flow heat exchangers and the thermosiphon heat exchangers are also connected to the higher pressure column and the lower pressure column so that at least one liquid condensate produced through condensation of the at least one nitrogen-rich vapor stream is introduced into the higher pressure column and the lower pressure column. A central conduit extends from a dome forming a top end of the higher pressure column and into the lower pressure column and the plurality of the down-flow heat exchangers are radially situated in radial locations with respect to the central conduit and connected to a shell of the lower pressure column. The condensing sides of the down-flow heat exchangers connected to the central conduit to receive the at least part of the at least one nitrogen-rich vapor stream from the higher pressure column. The plurality of thermosiphon heat exchangers are radially situated in radial locations with respect to the central conduit and between the down-flow heat exchangers and the dome such that the residual liquid collects within a region of the lower pressure column defined by the shell of the lower pressure column and the dome of the higher pressure column.

It is to be noted that in this aspect of the invention, the use of the central conduit allows the heat exchangers to be symmetrically situated in radial locations. One major advantage of this is that pressure drops in piping nitrogen-rich vapor streams to such heat exchangers are reduced. Furthermore, the down-flow and thermosiphon heat exchangers can be placed in closer proximity to one another to also reduce the column height that would otherwise be required in such a hybrid arrangement of heat exchangers.

The plurality of down flow heat exchangers each have heat exchange tubes, within which the oxygen-rich liquid partially vaporizes and a shell enclosing the heat exchange tubes and into which the at least part of the at least one nitrogen-rich vapor stream is introduced to perform the indirect heat exchange with the oxygen-rich liquid and thereby form the condensing side thereof. A return conduit can be provided in flow communication with the condensing side of the down-flow heat exchangers and with the higher pressure column so that part of the at least one condensate returns to the higher pressure column as reflux and a flow control valve can be positioned within the return conduit so that during turn-down or restart operations, flow of the part of the at least one condensate to the higher pressure column is restricted to partially flood the condensing side of down-flow heat exchangers and thereby preventing partial dry-out thereof on a vaporization side thereof located opposite to the condensing side.

The condensing sides can be connected to the higher pressure column so that one nitrogen-rich vapor stream condenses, the one nitrogen-rich vapor stream composed of nitrogen-rich vapor column overhead produced as a result of distillation occurring within the higher pressure column. The condensing sides of the down-flow heat exchangers and the thermosiphon heat exchangers are also connected to the higher pressure column and the lower pressure column so that one liquid condensate produced through condensation of the nitrogen-rich vapor stream is introduced into the higher pressure column and the lower pressure column as reflux.

BRIEF DESCRIPTION OF THE DRAWINGS

Although the present specification concludes with claims distinctly pointing out the subject matter that applicants regard as their invention, it is believed that the present invention will be better understood when taken in connection with the accompanying drawings in which:

DETAILED DESCRIPTION

Figure 1:
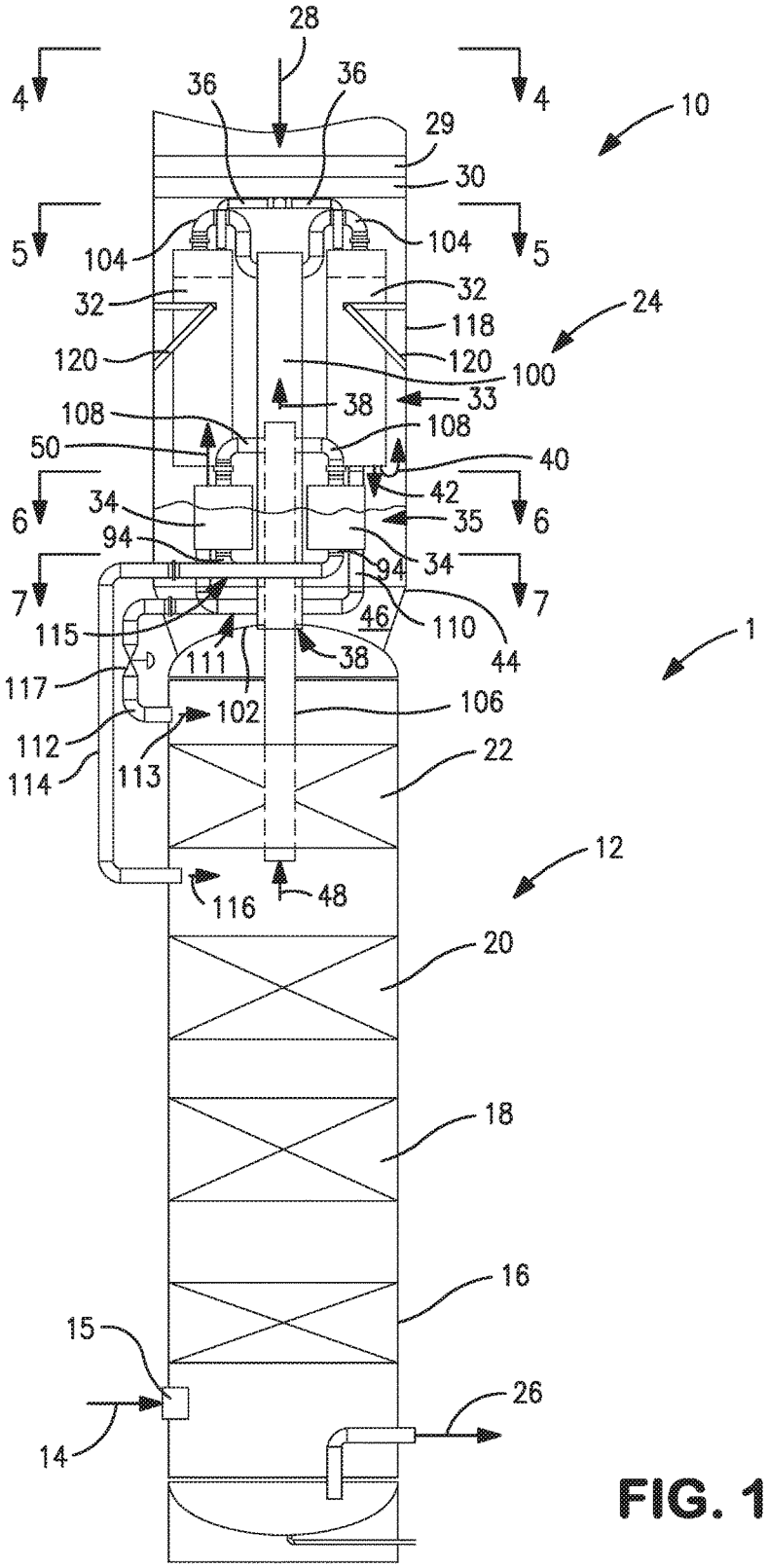
FIG. 1 is a sectional, schematic view of a main heat exchanger system in accordance with the present invention.

With reference to FIG. 1, a double column arrangement 1 is illustrated having a lower pressure column 10 and a higher pressure column 12. Double column arrangement 1 is used in an air separation plant having a main air compressor, a pre-purification unit and heat exchangers to compress, purify and cool air to a temperature at or near its dew point to be distilled in the double column arrangement 1 into oxygen-rich and nitrogen-rich fractions.

An incoming compressed and purified air stream 14 is introduced into an inlet 15 of the higher pressure column 12 to initiate formation of an ascending vapor phase that contacts a descending liquid phase within mass transfer contacting elements 16, 18, 20 and 22. As will be discussed, the initiation of formation of the descending liquid phase is accomplished by means of a main heat exchange system 24 of the present invention that is situated in the base of the lower pressure column 10 to condense nitrogen-rich vapor produced in the higher-pressure column 12 as a column overhead and thereby form reflux for at least the higher pressure column 12 and also possibly, the lower pressure column 10. The mass transfer contacting elements 16, 18, 20 and 22 can be known sieve trays, structured packing or random packing or a combination of such elements. The mass transfer contact between the ascending vapor and descending liquid phases produces crude liquid oxygen column bottoms of the higher pressure column 12 that collects in a sump thereof. The crude liquid oxygen, also known as kettle liquid, is withdrawn as a crude liquid oxygen stream 26 that is in turn further refined through distillation occurring in the lower pressure column 10 to also produce a nitrogen-rich vapor and downcoming oxygen-rich liquid that is collected from mass transfer contacting elements in the lower pressure column in a liquid collector, not illustrated, but well known in the art. The downcoming oxygen-rich liquid is in turn introduced from overlying mass transfer contacting elements as a stream 28 into a collector having a pan-like element 29 and a box-like central trough 30, also housed in the lower pressure column 10.

Main heat exchange system 24 has a plurality of down-flow heat exchangers 32 that form a down-flow heat exchange zone 33 and a plurality of thermosiphon heat exchangers 34, situated below the plurality of down-flow heat exchangers 32 and forming a thermosiphon heat exchange zone 35 for partially vaporizing the oxygen-rich liquid stream 28. As will be discussed, although the down-flow and thermosiphon heat exchangers 32 and 34 are of shell and tube design, other designs are possible and commonly used such as brazed aluminum plate fin construction. The downcoming oxygen-rich liquid is distributed from the trough 30 by means of a distributor formed by conduits 36 to the down-flow heat exchangers 32 where it partially vaporizes through indirect heat exchange with a first nitrogen-rich vapor stream 38 that is formed from the nitrogen-rich vapor column overhead within the higher pressure column 12. This partial vaporization produces a vapor stream, designated by arrowhead 40 and a liquid stream, designated by arrowhead 42 that collects within the sump 44 of the lower pressure column 10 as an oxygen-rich liquid column bottoms 46. Although not illustrated such oxygen-rich liquid column bottoms 46 could be taken as a liquid oxygen product or vaporized to produce a vapor oxygen product or pumped and heated to produce an oxygen product at pressure either as a vapor or a supercritical fluid. The oxygen-rich liquid column bottoms 46 is in turn vaporized in an up flow direction through the thermosiphon effect occurring within the thermosiphon heat exchangers 34 by means of indirect heat exchange with a second nitrogen rich stream 48 produced in the higher pressure column 12. The second nitrogen-rich stream 48 is also formed by nitrogen-rich vapor, but such vapor has a greater oxygen concentration than the first nitrogen-rich stream 38 since it is withdrawn from the higher-pressure column 12 at a location thereof below the first nitrogen-rich stream 38, specifically below mass transfer contacting elements 22. The vaporization produces another vapor stream, designated by arrowhead 50 that combines with the vapor stream 40 to form an ascending vapor phase to be contacted with the descending liquid phase within the lower pressure column 10 within the mass transfer contacting elements thereof.

Figure 2:
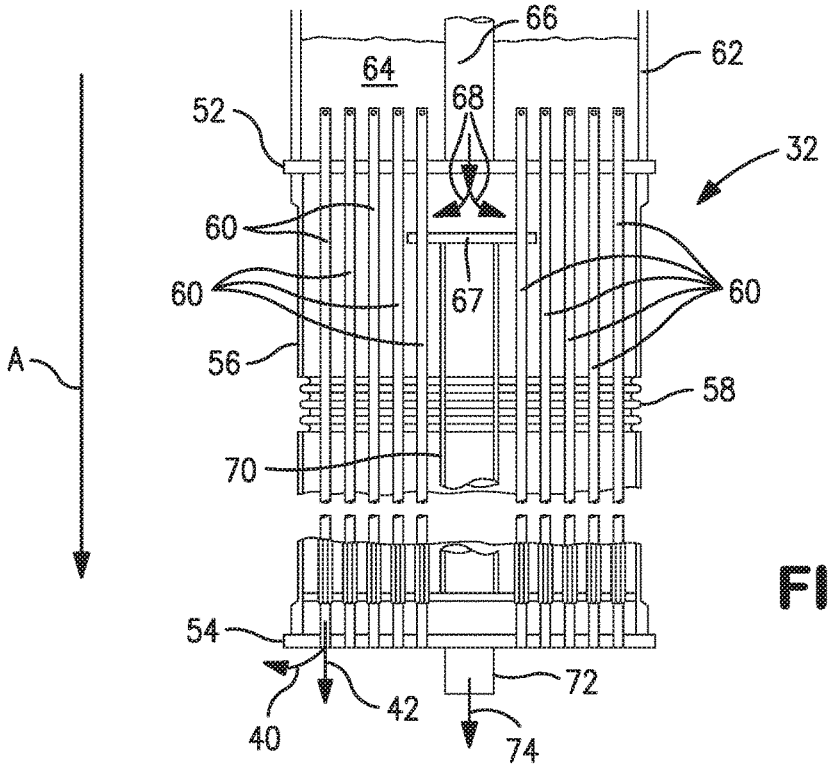
FIG. 2 is a schematic sectional view of a down-flow heat exchanger used in the main heat exchanger system of FIG. 1.

With reference to FIG. 2, a down-flow heat exchanger 32 is illustrated. Down-flow heat exchanger 32 is provided with two opposed tube sheets 52 and 54 that are connected by a cylindrical sidewall 56 having bellows 58 for thermal contraction purposes. The tube sheets 52 support a network of tubes 60 that are open at opposite ends. The tubes 60, at one end project into a reservoir 62 into which the oxygen-rich liquid 64 collected after having been fed thereto from conduits 36 (FIG. 1). The liquid flows in a downward direction of arrowhead "A" in the inside of the tubes 60 from reservoir 62 to be partially vaporized and emerge from the other end of the tubes 60 as the vapor stream 40 and the liquid stream 42, also mentioned above. In this type of shell and tube heat exchanger, the inside of the tubes 60 constitute the boiling side of the heat exchanger. Part of the first nitrogen stream 38 is introduced into inlet conduit 66 that is connected to and penetrates tube sheet 52. The incoming nitrogen-rich vapor contacts a deflector plate 67 and is deflected in outward radial directions indicated by arrowheads 68. Deflector plate 67 is supported by a central support 70 that is connected to tube sheet 54. The incoming nitrogen-rich vapor contacts the exterior surfaces of the tubes 60 and is condensed. Consequently, the exterior surfaces of the tubes 60 are the condensing side of such a heat exchanger. The resulting condensed nitrogen-rich liquid collects within the shell and is discharged from an outlet 72 connected to and penetrating tube sheet 54 as a first nitrogen-rich liquid stream designated by arrowhead 74. Preferably, down-flow heat exchanger 32 has the same design features as outlined in US Patent Appln. Ser. No. 2007/0028649 with enhanced boiling surfaces on the inside of tubes 60 and fins on the exterior of the tubes 60.

Figure 3:
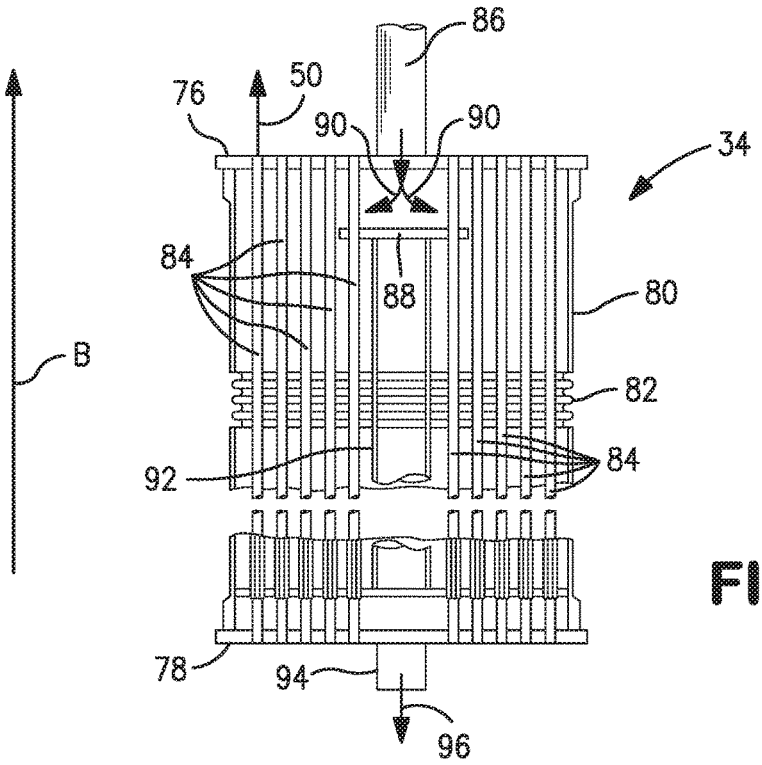
FIG. 3 is a schematic section view of a thermosiphon heat exchanger used in the main heat exchanger system of FIG. 1.

Referring now to FIG. 3, the thermosiphon heat exchanger 34 is also of shell and tube construction and is provided with opposed tube sheets 76 and 78 connected by a cylindrical side wall 80 having expansion bellows 82 and supporting a network of tubes 84 open at opposite ends. The entire thermosiphon heat exchanger 34 sits within oxygen-rich liquid column bottoms 46 that enters the tubes 84 at tube sheet 78 and is then vaporized as it flows in an upward direction indicated by arrow head B. The vapor stream 50, also referred to above, emerges from the other ends of the tubes 84 at tube sheet 76. Part of the second nitrogen-rich vapor stream 48 is introduced into the heat exchanger through an inlet conduit 86 connected to and penetrating tube sheet 76. The incoming vapor contacts a deflector plate 88 and is deflected in outward radial directions as indicated by arrowheads 90. Deflector plate 88 is supported by means of a central support 92 connected to the tube sheet 78. The resulting condensed nitrogen-rich liquid is discharged from an outlet 94 connected to and penetrating tube sheet 78 as a second nitrogen-rich liquid stream 96. Again, the inside of the tubes 84 is the vaporization side of the heat exchanger and the outside of the tubes is the condensing side of the heat exchanger. Again, preferably, thermosiphon heat exchanger 34 has the same design features as outlined in US Patent Appln. Ser. No. 2007/0028649 with enhanced boiling surfaces on the inside of tubes 84 and fins on the exterior of the tubes 84.

Referring to FIG. 1 again, as has been pointed out above, the down-flow heat exchanger 32 is able to have a closer approach temperature between condensing a boiling streams, namely, the first nitrogen-rich vapor stream 38 and the oxygen-rich liquid, respectively, than would be possible in a thermosiphon type of heat exchanger. However, since the thermosiphon heat exchangers 34 indirectly exchange heat with the second nitrogen-rich vapor stream 48 having more oxygen than the first nitrogen-rich vapor stream 38, the required temperature difference of the thermosiphon heat exchangers 34 do not limit the approach temperatures of the down-flow heat exchangers 32. The down-flow heat exchange zone 33 is designed to partially vaporize a greater proportion of the oxygen-rich liquid than the thermosiphon heat exchange zone 35 by known design techniques that involve providing a greater heat exchange area of the down-flow heat exchangers 32 than the thermosiphon heat exchangers 34. As a result, the higher pressure column 12 is able to be operated at a lower pressure and with colder nitrogen-rich vapor than would be possible if only thermosiphon heat exchangers been used for such purpose. This lower operational pressure translates into lower power costs in compressing the air. Practically, a flow ratio between the first nitrogen-rich vapor stream 38 and the total flow of both the first nitrogen-rich vapor stream 38 and the second nitrogen-rich vapor stream 48 is maintained at between 70.0 percent and 90.0 percent and preferably, 70.0 percent.

Obviously, even closer approach temperatures and lower pressures would be able to be obtained if all of the condensing reboiling duty were able to be accomplished in down-flow type heat exchangers. However, this could not be accomplished without the risk of partial "dry-out". During partial "dry-out", the residual oxygen-rich liquid leaving the downflow heat exchanger tubes is not sufficient to keep the tube inside surface completely wetted. In order to avoid partial dry-out the minimum liquid flow requirement as a fraction of the vapor flow exiting the tube should be 0.05 or higher. As a result, higher boiling contaminants are likely to be concentrated by freezing on the heat exchange surfaces. Since these high boiling contaminants include hydrocarbons that present a flammability hazard, such operational conditions are to be avoided. However, since the heat exchange and partial vaporization is now divided between the down-flow heat exchangers 32 and the thermosiphon heat exchangers 34, partial dry-out will not occur while enabling even closer approach temperatures that would be safe within a down-flow heat exchangers if such heat exchangers were used without the thermosiphon heat exchangers. As such, the present invention is able to obtain an advantage that more closely approaches the use of down-flow heat exchangers alone.

Figure 4:
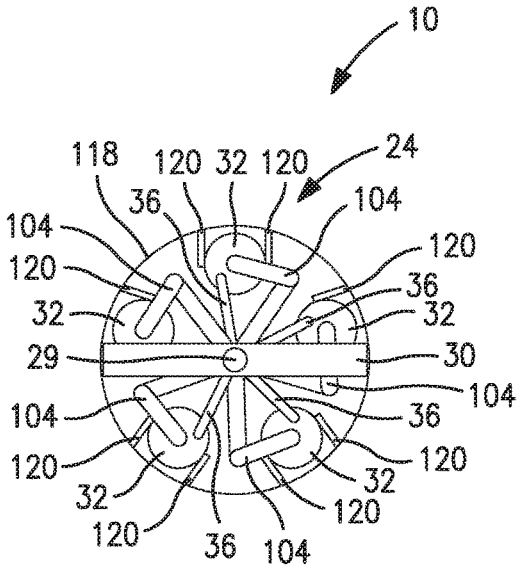
FIG. 4 is a fragmentary, sectional view of FIG. 1 taken along line 4-4 of FIG. 1 with a pan-like element of a liquid collector removed.
Figure 5:
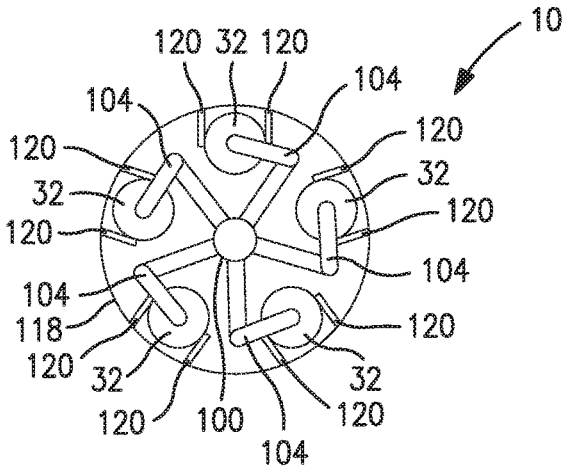
FIG. 5 is a sectional view of FIG. 1 taken along line 5-5 of FIG. 1.
Figure 6:
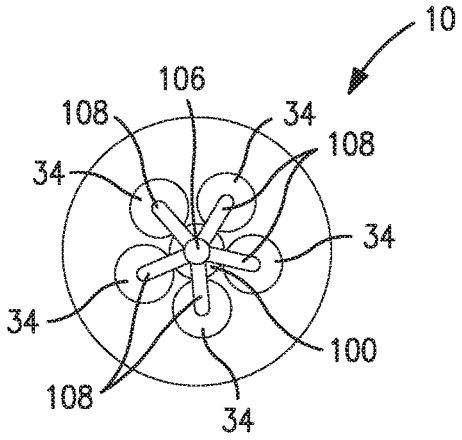
FIG. 6 is a sectional view of FIG. 1 taken along line 6-6 of FIG. 1.

With reference again to FIG. 1, a central conduit 100 extends from a dome 102 forming the top of the higher pressure column 12 into the lower pressure column 10 and through the sump 44 thereof. With additional reference to FIGS. 4 and 5, the central conduit 100 conducts the first nitrogen-rich vapor stream 38 from the top of the higher pressure column 12 to the condensing sides of the down-flow heat exchangers 32 by means of a spider-like array of conduits 104. Each of the conduits 104 is connected to an inlet conduit 66 shown in FIG. 2. Although separate conduits could be provided to conduct the second nitrogen-rich vapor stream 48 to the thermosiphon heat exchangers 34, preferably, a tube 106 is telescoped within central conduit 100 that penetrates the mass transfer contacting elements 22. Tube 106, as is the case of tube 100 is closed at the top end thereof. Alternatively, tube 106 can be configured as an outer tube and tube 100 could be configured as the inner tube. With additional reference to FIG. 6, another spider-like array of conduits 108 penetrate the central conduit 100 and are in communication with tube 106 to receive the nitrogen-rich vapor of the second nitrogen-rich vapor stream 48 and distribute the vapor to the thermosiphon heat exchangers 34. For such purposes, the conduits 108 are connected to the inlet conduits 86 of the thermosiphon heat exchangers 34 as illustrated in FIG. 3. Practically, a flow ratio between the first nitrogen-rich vapor stream 38 and the total flow of both the first nitrogen-rich vapor stream 38 and the second nitrogen-rich vapor stream 48 is maintained at between 50.0 percent and 90.0 percent and preferably about 70.0 percent. This can be achieved by appropriately sizing the conduits used for such purposes.

Figure 7:
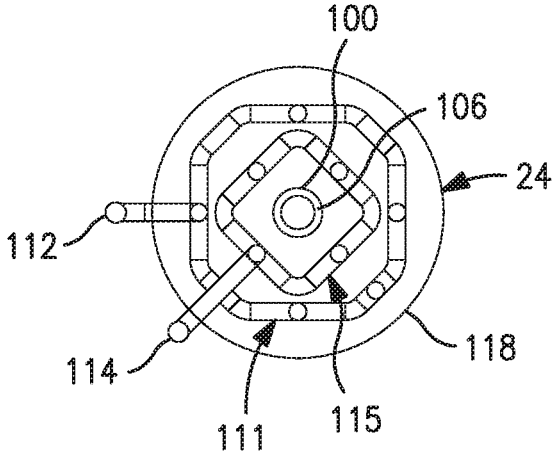
FIG. 7 is a sectional view of FIG. 1 taken along line 7-7 of FIG. 1.

With additional reference to FIG. 7, the nitrogen-rich liquid from the first nitrogen-rich liquid stream 74 discharged from each of the down-flow heat exchangers 32 at outlet 72 that is connected to downcoming pipes 110 that in turn are connected to a ring-like manifold 111. A return conduit 112, at one end, is in turn connected to the ring-like manifold 111. The other end of the return conduit 112 is configured to discharge a reflux stream 113 to the higher pressure column 12. It is understood that part of the stream could also be discharged to the lower pressure column 10 at top reflux. Additionally, another part of such stream could be taken as a liquid product or pumped and heated and taken as a pressurized product. The nitrogen-rich liquid from the second nitrogen-rich liquid stream 96 discharged from each of the thermosiphon heat exchangers 34 flows to a return conduit 114 that at one end is in flow communication with the outlet 94 of each of the thermosiphon heat exchangers 34. With brief reference to FIG. 7, this is accomplished by means of a ring-like manifold 115 that is connected to outlets 94 and also to return conduit 114. The other end of return conduit 114 is connected to the higher pressure column 12 to discharge an intermediate reflux stream 116 to the higher pressure column 12. It is understood that the intermediate reflux stream 116 could be introduced as top reflux to the lower pressure column 10. Further, as could be appreciated, that although not illustrated, both reflux streams 113 and 116 would be introduced into a liquid distributor to distribute the liquid to the underlying mass transfer contacting elements 22 and 20, respectively. Preferably, a flow control valve 117 can be positioned within return conduit 112. Partial closure of this valve allows flow of the first nitrogen-rich vapor stream after having been condensed to partially flood the condensing side of down-flow heat exchangers 32 and thereby prevent partial dry-out.

The down-flow heat exchangers are connected to an outer shell 118 of the lower pressure column 10 by bracket-like members 120 that are welded to the outer shell 118 and the cylindrical sidewall 56 of the down-flow heat exchangers 32. It is to be that this arrangement together with the central conduit 100 avoids the use of piping that would otherwise have to penetrate the outer shell 118 and fit between a liquid distributor and the down-flow heat exchangers 32. Furthermore, the use of the central conduit 100 also allows the down-flow heat exchangers to be positioned in a regular radial arrangement and with less pressure drop than had such piping, penetrating the outer shell 118, been utilized. The same benefits are able to be obtained for the thermosiphon heat exchangers 34 with the use of the inner tube 106. The arrangement in addition to the foregoing, allows the thermosiphon heat exchangers 34 to be positioned vertically closer to the down-flow heat exchangers 32 than would otherwise be possible leading to a more compact arrangement and a shorter lower pressure column 10 than would otherwise be possible in such a hybrid arrangement. The advantage of limiting column height will result in a savings of fabrication costs. This being said, embodiments of the present invention are possible in which only the central conduit 100 is used to feed the down-flow heat exchangers 32 with the nitrogen-rich vapor or even alternatively, where there are no central conduits 100 and inner tube 106. In such case, the down-flow heat exchangers 32 and the thermosiphon heat exchangers 34 would be fed with nitrogen-rich vapor through separate arrangements of piping penetrating the column shells. It is to be noted that it is also possible to utilize the advantage of the central conduit 100 and the inner tube 106 or the central conduit 100 alone in any hybrid arrangement of heat exchangers, even such arrangements were the nitrogen-rich vapor fed to the down-flow heat exchanger and the thermosiphon heat exchangers have the same concentration of nitrogen and oxygen as in the prior art.

While the present invention has been discussed with respect to preferred embodiments, as will occur to those skilled in the art, numerous changes, additions and omission can be made thereto without departing from the spirit and scope of the invention as set forth in the presently pending claims.

We claim:

1. A main heat exchange system for reboiling a lower pressure column of a double column arrangement, the main heat exchange system comprising:

a plurality of down-flow heat exchangers and a plurality of thermosiphon heat exchangers situated below the plurality of down-flow heat exchangers for partially vaporizing an oxygen-rich liquid produced as a result of a distillation of an oxygen and nitrogen containing mixture within the lower pressure column and initiating the formation of an ascending vapor phase of the oxygen and nitrogen containing mixture to be distilled within the lower pressure column;

the plurality of the down-flow heat exchangers configured to partially vaporize a greater proportion of the oxygen-rich liquid than the plurality of the thermosiphon heat exchangers and the plurality of the down-flow heat exchangers and the plurality of thermosiphon heat exchangers having condensing sides connected to the higher pressure column of the double column arrangement so that at least one nitrogen-rich vapor stream condenses through indirect heat exchange with the oxygen-rich liquid occurring within the down flow heat exchangers and through indirect heat exchange with residual liquid occurring within the thermosiphon heat exchangers, the residual liquid formed from partial vaporization of the oxygen-rich liquid within the down-flow heat exchangers;

the condensing sides of the down-flow heat exchangers and the thermosiphon heat exchangers also connected to the higher pressure column and the lower pressure column so that at least one liquid condensate produced through condensation of the at least one nitrogen-rich vapor stream is introduced into the higher pressure column and the lower pressure column;

a central conduit extending from a dome forming a top end of the higher pressure column and into the lower pressure column;

the plurality of the down-flow heat exchangers radially situated in radial locations with respect to the central conduit and connected to a shell of the lower pressure column;

the condensing sides of the down-flow heat exchangers connected to the central conduit to receive the at least part of the at least one nitrogen-rich vapor stream from the higher pressure column;

the plurality of thermosiphon heat exchangers radially situated in radial locations with respect to the central conduit and between the down-flow heat exchangers and the dome such that the residual liquid collects within a region of the lower pressure column defined by the shell of the lower pressure column and the dome of the higher pressure column;

wherein the at least one liquid condensate comprises a first reflux introduced into the higher pressure column, and a second reflux introduced into the higher pressure column at a location below the first reflux.

2. The main heat exchange system of claim 1 wherein the plurality of down flow heat exchangers each have heat exchange tubes, within which the oxygen-rich liquid partially vaporizes and a shell enclosing the heat exchange tubes and into which the at least part of the at least one nitrogen-rich vapor stream is introduced to perform the indirect heat exchange with the oxygen-rich liquid and thereby forms the condensing side thereof.

3. The main heat exchange system of claim 1 wherein:

a return conduit is in flow communication with the condensing side of the down-flow heat exchangers and with the higher pressure column so that part of the at least one condensate returns to the higher pressure column as the first reflux; and a flow control valve is positioned within the return conduit so that during turn-down or restart operations, flow of the first reflux to the higher pressure column is restricted to partially flood the condensing side of down-flow heat exchangers and thereby preventing partial dry-out thereof on a vaporization side thereof located opposite to the condensing side.

* * * * *